United States Patent [19]

Passmore et al.

[11] Patent Number: 5,041,041

[45] Date of Patent: Aug. 20, 1991

[54] METHOD OF FABRICATING A COMPOSITE LAMP FILAMENT

[75] Inventors: Edmund M. Passmore, Gloucester, Mass.; Thomas J. Patrician, Monroeton, Pa.

[73] Assignee: GTE Products Corporation, Danvers, Mass.

[21] Appl. No.: 663,185

[22] Filed: Feb. 27, 1991

Related U.S. Application Data

[60] Continuation of Ser. No. 522,483, May 11, 1990, abandoned, which is a continuation of Ser. No. 235,742, Aug. 19, 1988, abandoned, which is a division of Ser. No. 945,746, Dec. 22, 1986, abandoned.

[51] Int. Cl.[5] ..... H01J 9/04

[52] U.S. Cl. ..... 445/48; 445/50

[58] Field of Search ..... 445/48, 50, 51

[56] References Cited

U.S. PATENT DOCUMENTS

| | | | |
|---|---|---|---|
| 1,123,625 | 1/1915 | Thowless | 427/111 |
| 2,269,081 | 1/1942 | Felsner | 313/345 |
| 2,488,731 | 11/1949 | Lambert et al. | 313/345 |
| 2,524,263 | 10/1950 | Kingston : | |
| 2,842,440 | 7/1958 | Nachtman et al. | 228/156 |
| 2,888,740 | 6/1959 | Danis . | |
| 3,168,399 | 2/1965 | Takahashi . | |
| 3,284,230 | 11/1966 | Heytmeijer et al. | 427/111 |
| 3,372,297 | 3/1968 | Pearsall et al. | 313/345 |
| 3,401,297 | 9/1968 | Feinleib | 313/345 |
| 3,537,493 | 11/1970 | Hagarman . | |
| 3,600,790 | 8/1971 | Dion . | |
| 3,777,362 | 12/1973 | Nilsson . | |
| 3,778,355 | 12/1973 | Johnson . | |
| 3,780,418 | 12/1973 | Hurst . | |
| 3,780,554 | 12/1973 | Nilsson . | |
| 3,922,769 | 12/1975 | Brenan . | |
| 4,015,765 | 4/1977 | Ahmed | 228/156 |
| 4,105,908 | 8/1978 | Harding et al. | 313/631 |
| 4,296,352 | 10/1981 | Berlec et al. | 313/345 |
| 4,683,397 | 7/1987 | Johnson | 445/48 |

FOREIGN PATENT DOCUMENTS

| | | |
|---|---|---|
| 836810 | 3/1970 | Canada . |
| 0019992A1 | 10/1980 | European Pat. Off. . |
| 3036746A1 | 4/1981 | Fed. Rep. of Germany . |
| FR-A-1234443 | 5/1960 | France . |
| FR-A-1464066 | 11/1966 | France . |
| 2079531A | 1/1982 | United Kingdom . |

OTHER PUBLICATIONS

Patent Abstracts of Japan, vol. 5, No. 59(E-53), Apr. 22, 1981 & JP-A-56 11832 (Toshiba), Feb. 5, 1981.

Patent Abstracts of Japan, vol. 2, No. 64(E-33), May 17, 1978 & JP-A-53 30266 (Toshiba), Mar. 22, 1978.

Patent Abstracts of Japan, vol. 8, No. 258 (M-340), Nov. 27, 1984, & JP-A-59 130697 (Iwasaki Denki KK), Jul. 27, 1984.

Patent Abstracts of Japan, vol. 6, No. 91 (E-109) (969), May 28, 1982, & JP-A-57 25664 (Mitsubishi Denki K.K.), Feb. 10, 1982.

*Primary Examiner*—Kenneth J. Ramsey

*Attorney, Agent, or Firm*—Joseph S. Romanow

[57] ABSTRACT

The present invention provides a tungsten-based duplex composite member, e.g., wire or rod, which combines the emissive, nonsag, or other desirable qualities of an inner tungsten-based core material with a different combination of properties, for example, resistance to attack, by the presence of a different tungsten-based material as an outer sheath or shell surrounding the core material.

In one embodiment of the present invention, an electrode is formed from a duplex composite member, composed of a thoriated tungsten core (W-$ThO_2$) and a thin rhenium (Re) shell.

Other embodiments of duplex composite members are provided by thoriated tungsten discharge electrodes in which it is desirable to have two different concentrations of thoria ($ThO_2$) in the element, a first concentration in the core of the duplex composite member and a second concentration in the shell or surface of the member.

9 Claims, No Drawings

METHOD OF FABRICATING A COMPOSITE LAMP FILAMENT

This application is a continuation of application Ser. No. 07/522,483, filed May 11, 1990, now abandoned; which is a continuation of application Ser. No. 235,742 filed Aug. 19, 1988, now abandoned; which is a division of application Ser. No. 945,746, filed Dec. 22, 1986, now abandoned.

BACKGROUND OF THE INVENTION

The present invention is directed to a duplex composite member suitable for use in lamps, as either an electrode and/or a filament element. This duplex composite member has two component parts; (1) a core composed of one type of tungsten-based material, and (2) a shell composed of a different tungsten-based material.

The duplex composite member of the present invention may have desirable surface properties such as resistance to chemical attack and/or mechanical shock and vibration, making it especially well suited for applications in incandescent lamps, metal halide discharge lamps, and/or halogen incandescent lamps.

Electrode and/or filament failure due to mechanical shock and/or chemical attack is a recognized problem in the lighting industry. For example, U.S. Pat. No. 4,413,205 describes in detail how the tungsten conductors to the coiled filament of a halogen incandescent lamp are locally pitted and chemically attacked by bromine in such a manner that they break and the lamp fails.

The 4,413,205 patent suggests one method for reducing this chemical attack problem, namely, modifying the conductor material to a tungsten rhenium (Re) alloy containing at least 0.1% Re.

Similarly, it is known that filament and/or electrode failure due to chemical attack can also occur in metal halide high intensity discharge (HID) lamps, especially where reactive halogens, including bromine, chlorine, and iodine have been used. See, for example J. F. Waymouth, "Electric Discharge Lamps" pg. 210, (1971).

The chemical attack of thoriated tungsten electrode rods thus constitutes a recognized obstacle in the application of the reactive halogens in metal halide discharge lamps.

Although such changes in electrode composition as those described in the 4,413,205 patent may overcome the problem of electrode failure due to chemical attack, such alloys suffer from two major shortcomings:

(a) they do not possess the necessary emissive characteristics of the W - (usually 1–2%) $ThO_2$ materials typically used for electrodes and (b) they introduce excessive Re emission into the light emitting plasma discharge of metal halide lamps.

The present invention is directed to an alternate solution to the problems of chemical attack and/or mechanical shock of electrodes and/or filaments, which does not suffer the disadvantages discussed above.

SUMMARY OF THE INVENTION

The present invention provides a tungsten-based duplex composite member, e.g., wire or rod, which combines the emissive, nonsag, or other desirable qualities of an inner tungsten-based core material with a different combination of properties, for example, resistance to corrosive attack, by the presence of a different tungsten-based material as an outer sheath or shell surrounding the core material.

One example of the benefits which may be conferred by the present invention is exemplified by the manner in which the aforementioned difficulties of the prior art may be avoided. In one embodiment of the present invention, an electrode is formed from a duplex composite member, composed of a thoriated tungsten core (W - $ThP_2$) and a thin tungsten-rhenium (Re) shell. In this embodiment, any rhenium emission is limited to an insignificant amount (i.e., that vaporized from the thin shell, especially at the tip of the electrode).

Other embodiments of duplex composite members are provided by thoriated tungsten discharge electrodes in which it is desirable to have two different concentrations of thoria ($ThO_2$) in the element, a first concentration in the core of the duplex composite member and a second concentration in the shell or surface of the member. In preferred embodiments, the thoria concentration in the shell portion ,of the duplex composite may be either lower or higher than the thoria concentration in the core portion.

One desirable objective which can be facilitated by the use of the duplex composite member of the present invention is the ability to draw thoriated core tungsten to much finer sizes (i.e., smaller diameters) than heretofore feasible.

Prior to the present invention, the limit of wire sizes for thoriated tungsten (with much greater than about 1% $ThO_2$) was no lower than about 0.020 inch in diameter. By utilizing a duplex composite member of the present invention composed of a 2% thoriated tungsten core with a 1% thoriated tungsten shell, drawn wire of 0.017 inches in diameter has readily been prepared. Unlike the 0.020 inch diameter wire previously prepared, this 0.017 inch diameter wire is especially well suited for use in low wattage metal halide lamps, i.e. 40 to 100 watts.

DETAILED DESCRIPTION OF THE PREFERRED EMBODIMENTS

As set forth above, the present invention provides a tungsten-based duplex composite member, e.g., wire or rod, which combines the emissive, nonsag, or other desirable qualities of an inner tungsten-based core material, with a different combination of properties for example, resistance to attack, by the presence of a different tungsten-based material as an outer sheath or shell surrounding the core material.

As used herein, the term "tungsten-based material" is defined as tungsten-containing compositions suitable for use as filament and/or electrode members in lamps, especially incandescent lamps, metal halide discharge lamps, and halogen incandescent lamps. Typically tungsten makes up at least about 95 percent (by weight), or more, of such compositions. After careful consideration of the teachings of the present disclosure, the skilled artisan will readily recognize suitable compositions for use herein.

Core materials may include thoriated tungstens, for example, tungsten compositions containing thoria in the range of from about 0.5 to about 5.0 percent (by weight). Other types of tungsten-based materials which may constitute the core include nondoped, i.e., commercially pure (CP) tungsten, potassium (K) doped nonsag tungsten (normally used in incandescent filaments), and tungsten alloys. Such materials are known to the skilled artisan in the lighting field.

Other core materials include tungsten modified with emissive materials such as $CeO_2$, $La_2O_3$, $Sc_2O_3$, $HfO_2$, $ZrO_2$, and the like, in concentrations ing up to about 5 percent (by weight). Combinations of these emitters with and without thoria may also be employed as a tungsten-based core material herein.

Another example of a useful tungsten-based core material is provided by Japanese Patent No. 58-129741; which describes the use of a tungsten electrode containing 20 ppm aluminum (Al). This Al level substantially exceeds currently specified levels of this element in wire).

As shell materials, any of the above described core materials may be employed, with the proviso that the core material and the shell material of any given duplex composite member are not the same.

In addition, attack and corrosion-resistant tungsten-rhenium alloys may also be used as shell materials. Such (Re)alloys, containing up to about 5% Re (by weight) will also promote mechanical shock and vibration resistance, making the duplex composite member especially well suited for use as incandescent filaments for applications involving such shock and vibration, while minimizing the amount of expensive Re which must be used and enhancing the luminous efficacy by the use of a K-doped, nonsag core.

Such a combination with a tungsten-rhenium (W-Re) shell around a potassium (K)-doped, nonsag core enables the composite to be used as the filament of a halogen inandescent lamp, in which separate internal conductors are not required.

In general, duplex composites are prepared by isostatically cold pressing the preblended and preplaced powders together into a billet with the core preplaced concentrically within the shell. The billet is then densified by sintering at a high temperature and reduced to wire of the desired diameters by the usual tungsten processing methods of rolling, swaging and drawing.

The present invention will be further illustrated with reference to the following examples which will aid in the understanding of the present invention, but which are not to be construed as limitations thereof. All percentages reported herein, unless otherwise specified, are percent by weight. All temperatures are expressed in degrees Celsius.

EXAMPLE I

Duplex composite electrodes with a 2% thoria core inside a 1% thoria shell were prepared for testing in both 100 watt and 400 watt metal halide lamps (Sylvania Metalarc lamps).

When viewed as a polished cross-section, the 2% thoria core is clearly revealed in contrast to the 1% thoria shell, which has a much coarser grain structure, being attributed to the larger grain size following the previous recrystallization-anneal.

The mold used in this example consisted of three main sections, a cylindrically shaped outer PVC mold support tube (2.25 in. I.D.×20 in.); a cylindrically shaped outer mold member (2 in. I.D.×24 in.) and a cylindrically shaped stainless steel inner mold/fill tube (1 in.×36 in.).

A portion of the upper section of the stainless steel inner mold/fill tube was flared out to a diameter of 2 in. to act as a funnel for the introduction of powders. At the bottom of the outer PVC mold support tube was placed a segment of hard rubber, which acted as a shock absorber. The three component parts were concentrically fitted together and filling was conducted as described below.

The procedure used to prepare this duplex composite started by adding 3,000 grams of W-2% $ThO_2$ powder to the central fill tube of the mold described above. At the same time, 1,000 grams of W-1% $ThO_2$ powder was placed in the space between the mold and the central fill tube.

The entire assembly was gently tapped during the filling operation until the prescribed amounts of both powders were added to the mold. At the end of the filling operation the levels of powder in the core and the outer shell were approximately the same. One critical aspect of filling is that the powders are only loosely packed into the mold since tight packing prevents the removal of the central filling tube.

After filling and the extraction of the fill tube, the mold was sealed, then cold isostatically pressed at a pressure of approximately 45,000 lbs per square inch. The pressed powder compact was then solid state sintered for about 12 hours at about 2,100° C. in a hydrogen atmosphere producing a composite ingot weighing about 13 kg with a density of 17.6 g/cc, i.e., about 93% of the theoretical density.

The resulting ingot was about 1.5 inches in diameter by about 19 inches long. The W-1% $ThO_2$ shell comprised about 70% of the ingot volume with the W-2% $ThO_2$ making up the remainder, producing an ingot with an average $ThO_2$ content of 1.34% by analysis.

Reduction of the ingot began first by rolling on a two-high rolling mill from 1.5 to 1.0 inch in diameter in multiple-passes at a temperature above 1300° C. After recrystallization, the ingot was rolled twice at a temperature above 1400° C. on a multiple stand rolling mill manufactured by Frederick Kocks Co., to a diameter of about 0.3 inch with an intermediate recrystallization.

The ingot was further reduced to about 0.1 inch diameter by multiple-pass swaging with three more recrystallization anneals. Because the diffusivity of $ThO_2$ in tungsten is very low for all of the processing temperatures employed herein, the interface between the W-1% $ThO_2$ outer shell and the W-2% $ThO_2$ core remains distinct, maintaining the duplex composite structure. Below 0.1 inch diameter the ingot was drawn into wire using conventional wiredrawing practices for W-$ThO_2$ wire.

The duplex composite wire made thereby was drawn to 0.039 inch diameter. Cathode rods for 400 watt metal halide lamps were prepared therefrom by centerless grinding to 0.0365 inch diameter and sectioning the ground rods into ½ inch lengths. These members were used to prepare seventeen 400 watt Metalarc-type lamps (having an arc tube fill comprising Na, Sc, I, and Hg) each of which lighted and operated normally in accordance with their design ratings.

The remainder of the 0.039 inch wire was drawn further to a diameter of 0.017 inch and this drawn wire was sectioned into 0.0295 inch segments. These small segments were used to prepare five 100 watt metal halide lamps, also having an arc tube fill comprising Na, Sc, I, and Hg. These lamps operated normally after burning for over 2000 hours. They were also found to start slightly faster than the standard lamps having a 1% thoria cathode, in this case 91 seconds versus 95 seconds.

EXAMPLE II

A duplex composite member is also prepared, using essentially the same procedures set forth in Example I, but with a non-thoriated core of tungsten encased in a shell of 2% thoria. 100 Watt Metalarc type lamps made therefrom are found to start much faster than the standard Metalarc lamps having a 1% thoria electrode. The lamps will also demonstrate improved lumen maintenance, especially when compared to prior art lamps with the same rapid starting characteristics, but wherein 2% thoriated tungsten makes up the entire electrode.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A method of fabricating a composite lamp member, said member including a core formed from a first compacted tungsten-based material and a shell intimately bonded to the outer surface of said core, said shell being formed from a second compacted tungsten-based material, said method comprising the following steps:

(a) inserting said first tungsten-based material within a centered fill tube of a cylindrical mold;

(b) inserting said second tungsten-based material in powder form into the space surrounding said fill tube and within said mold;

(c) extracting said fill tube from said mold such that a composite cylindrical billet is formed within said mold;

(d) removing said billet from said mold;

(e) cold pressing said billet isostatically;

(f) sintering said billet thereby forming a composite ingot; and (g) rolling, swaging, and drawing said composite ingot thereby forming a composite wire; and (h) forming said composite lamp member from said wire.

2. A method of fabricating a composite lamp member as described in claim 1 wherein said shell includes a material selected from the group consisting of thorium and rhenium in an amount approximately equal to five percent or less by weight.

3. A method of fabrication a composite lamp member as described in claim 2 wherein said core consists essentially of tungsten.

4. A method of fabrication a composite lamp member as described in claim 1 wherein said core and said shell both include the same material selected from the group consisting of thorium and rhenium in different amounts.

5. A method of fabrication a composite lamp member as described in claim 1 wherein said cold isostatic pressing of said composite billet is performed at approximately 45,000 pounds per square inch.

6. A method of fabrication a composite lamp member as described in claim 1 wherein said sintering of said billet lasts approximately twelve hours at approximately 2,100 degrees Celsius.

7. A method of fabrication a composite lamp member as described in claim 1 wherein said composite ingot has a density of approximately 93 percent of its theoretical density.

8. A method of fabrication a composite lamp member as described in claim 1 wherein said composite wire has a cross-sectional diameter of approximately 0.039 inch.

9. A method of fabrication a composite lamp member as described in claim 1 wherein said composite wire has a cross-sectional diameter of approximately 0.017 inch.

* * * * *